US005460370A

United States Patent [19]

Tung-Han

[11] Patent Number: 5,460,370

[45] Date of Patent: Oct. 24, 1995

[54] STRUCTURE OF RACKET

[76] Inventor: Lai Tung-Han, Suite 1, 11F. No. 95-8 Chang Ping Rd. Sec. 1, Taichung, Taiwan

[21] Appl. No.: 303,513

[22] Filed: Sep. 9, 1994

[30] Foreign Application Priority Data

Nov. 29, 1993 [CN] China ..... 93245054.7

[51] Int. Cl.[6] ..... A63B 49/12

[52] U.S. Cl. ..... 273/73 H; 273/73 R; 273/73 C; 273/73 D; 273/73 G

[58] Field of Search ..... 273/73 R, 73 C, 273/73 D, 73 G, 73 H

[56] References Cited

U.S. PATENT DOCUMENTS

| | | | |
|---|---|---|---|
| 3,752,478 | 8/1973 | Flak | 273/73 H |
| 4,066,260 | 1/1978 | Rodgers, Jr. | 273/73 H X |
| 4,176,841 | 12/1979 | Sommer | 273/73 H |
| 4,436,305 | 3/1984 | Fernandez | 273/73 H X |
| 5,184,818 | 2/1993 | Lo | 273/73 H |
| 5,249,799 | 10/1993 | Chang | 273/73 H X |

*Primary Examiner*—Raleigh W. Chiu

[57] ABSTRACT

A structure of racket comprises generally an oval shaped head, a throat and handle, which is shaped by a tubular metal having an olive shaped cross section having a rectangular groove centrally extended along the length of the inward periphery and an arcuate groove centrally extended along the length of the outward periphery, both terminated at a position where the throat is latterly formed. The grooves are connected on their lateral sides by a pair of symmetrically arcuate ribe inside the tubular metal. A plurality of string holes are punched through the grooves in predetermined number and space prior to that the metal is bent into oval shaped. The handle is formed by juxlaposing two ends of the tubular metal and bound with vibration absorbing material. A separately made transverse portion screw secures to the inward periphery of the frame above the throat for stringing arrangement. This disclosure has been characterized in a simplized durable structure for saving the time and cost to manufacture.

4 Claims, 4 Drawing Sheets

STRUCTURE OF RACKET

BACKGROUND OF THE INVENTION

The present invention relates to rackets, more particularly to a structurally improved racket having an integrally formed metallic frame which facilitates a pre-punching of string holes and hence durability.

Prior art racket generally comprises an oval head integral with a throat and a handle. The string holes are most likely punched after the oval shaped frame is formed. Thus causing inconvenience to manufacture.

In view of the inefficiency above, manufacturers have begun to produce metallic racket which is made from a cylinder or a tubular metal having pressed roughly rectangular grooves on opposite periphery of the frame along a longitudinal direction that forms an I-shape section at center abutting the bottom of the grooves. So that the straight workpiece facilitates to mechanically punch string holes before it is bent to oval shaped frame in order to solve the problem as recited above. But the I-shape section may be feeble to resist an external heavy impact against the string surface of the racket and would cause a deformation.

SUMMARY OF THE PRESENT INVENTION

The main object of the present invention is to provide a structure of racket having metallic frame of specially designed cross section which is durable and facilitates mechanical punching of string holes in order to save the time and cost to manufacture.

Another object of the present invention is to provide a structure of racket having a smooth and sleek outer appearance and a reinforced intensity to resist an external heavy impact against the string surface of the racket.

Accordingly, the structure of racket of the present invention comprises generally an oval head connecting to a throat and a handle.

A tubular metal of which the racket is made comprises an olive shaped cross section having a pair of vertical ribs therein a rectangular groove formed on the inward peripheral center and extended along the length of the metal, so as to define a rectangular space and a pair of obtuse-angle triangular spaces therein. An arcuate groove is centrally pressed on the outward peripheral center along a longitudinal direction and terminated together with the rectangular groove at a position where the throat of the racket is formed hereupon. A plurality of string holes in predetermined space are then mechanically punched along the length of the arcuate groove prior to that the metal is bent to form a regular racket.

There is another alterative embodiment comprising a tubular metal which has an olive cross section and grooves thereon similar to above discussed embodiment except the pair of the vertical ribs which is omitted in favor of manufacture and hence in appropriate intensity.

The present invention will become more fully understood by reference to the following detailed discription thereof when read in accompanying with the attached drawings.

DETAIL DESCRIPTION OF THE PREFERRED EMBODIMENT OF THE PRESENT INVENTION

Figure 1:
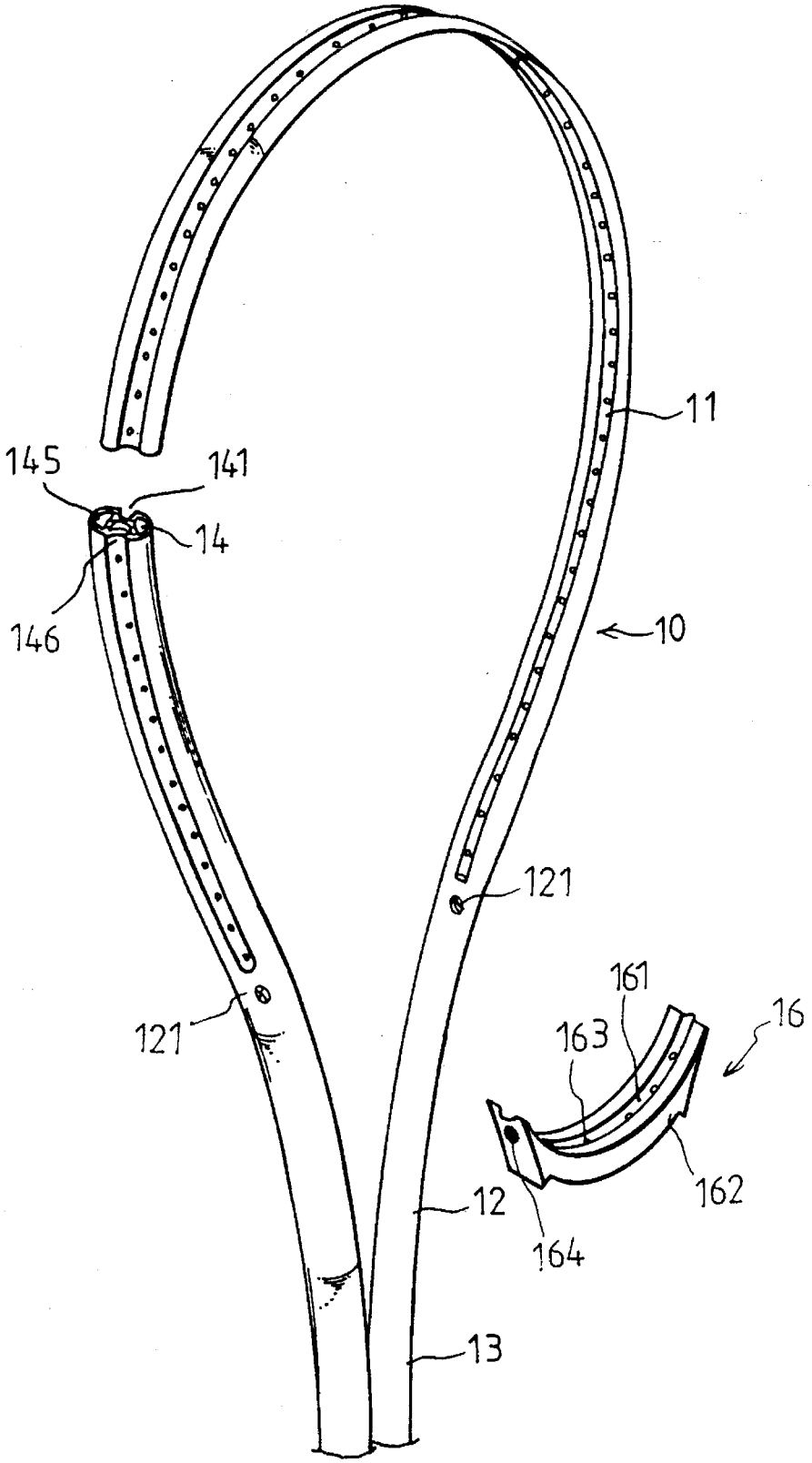
FIG. 1 is a perspective view to show the frame of a racket according to the present invention.
Figure 2A:
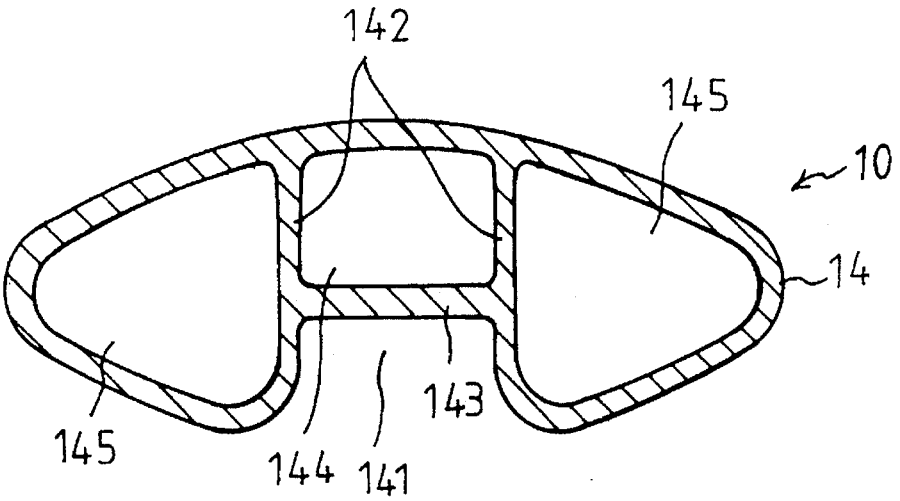
FIGS. 2A and 2B are the sectional views to show a preferred embodiment of the present invention.
Figure 2B:
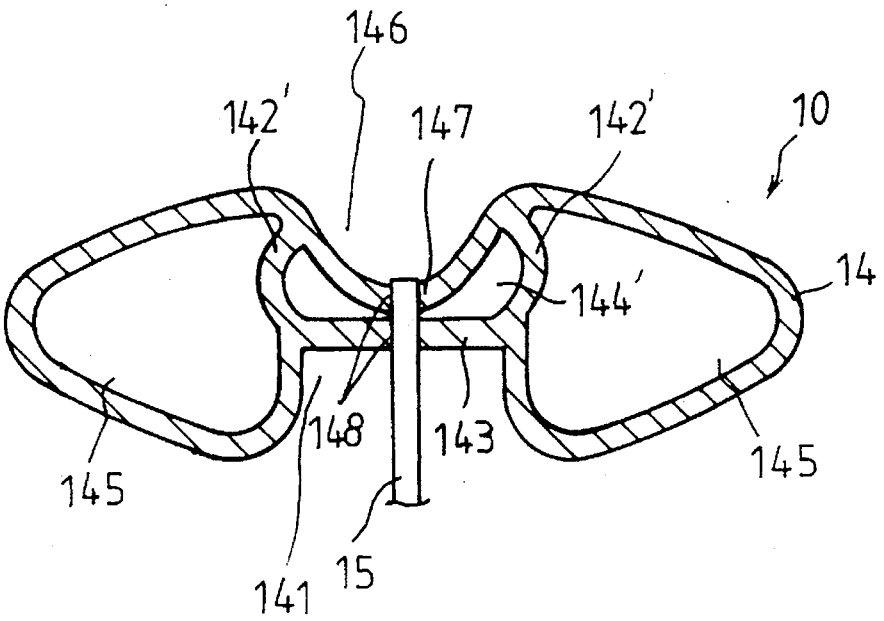

With reference to FIGS. 1, 2A and 2B of the drawings, a structure of racket of the present invention comprises a tubular metal 10 being lately bent to an oval shaped frame 11, a throat 12 and a handle 13.

The tubular metal 10 which has an olive shaped cross section 14 has a rectangular groove 141 centrally formed on the inward periphery and extended along the length of the metal 10 and then terminated at a position where the throat 12 of the racket 10 is formed hereupon, a pair of vertical ribs 142 inside the tubular metal conneted to the interior lateral ends of the bottom 143 of the rectangular groove 141 and the interior surface of the outward periphery of the metal 10 and extended along the length thereof, so as to define a rectangular space 144 abutting a pair of obtuse-angle triangular spaces 145 inside the tubular metal (as shown in FIG. 2A).

An arcuate groove 146 is centrally formed by press on the outward periphery of the metal 10 and extended along the length thereof and then terminated at a position in registry with the ends of the rectangular groove 141. You'll see that the bottoms 143 and 147 of the grooves 141 and 146 are nearly closed inside the tubular metal and the pair of the vertical ribs 142 are now symmetrically bent to arcuate 142' (as shown in FIG. 2B) and the rectangular space 144 becomes a pair of petalled shapes 144'. A plurality of string holds 148 in predetermined number and space are mechanically punched through the grooves 141 and 146 for anchoring strings 15 prior to that the metal 10 is bent to regular shape of a racket hereupon. A pair of screw holes 121 respectively formed abutting the two ends-of the grooves 141 and 146.

A transverse portion 16 for completing the oval shaped frame 11 is provided having an arcuate upper edge in accommodating with the curvature of the inward periphery of the oval shaped frame 11 including an elongate arcuate groove 161 centrally formed along it's length of the upper surface, an elongate rectangular groove 162 centrally formed along the length of the under side thereof and a plurality of string holes 163 in predetermined number and space are punched along the grooves 161 and 162 therethrough. A pair of screw holes 164 formed at two ends respectively in registry with the screw holes 121 of the frame 11. The transverse portion 16 is made separately and secured to the frame above the throat of the racket latterly.

Figure 3A:
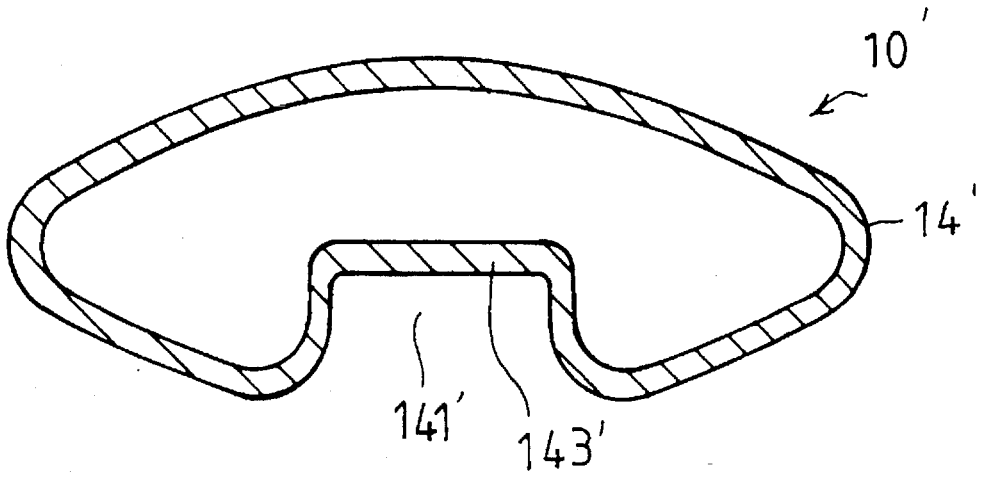
FIGS. 3A and 3B are the sectional views to show an alternative embodiment of the present invention.
Figure 3B:
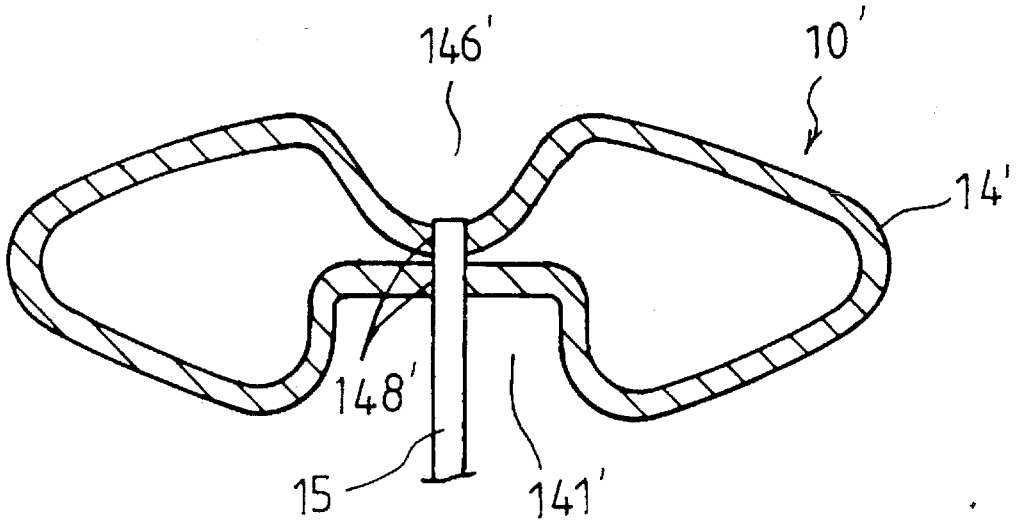

Referring to FIGS. 3A and 3B, an alterative embodiment of the present invention is provided in the type similar to the above recited embodiment except a pair of the vertical ribs inside the tubular metal are omitted for providing more convenience to manufacture.

The tubular metal 10' used is also in olive shaped cross section 14 having a rectangular groove 141' centrally formed on the inward periphery and extended along the length of the metal 10' and then terminated at a position where the throat 12 of the racket 10 is formed hereupon and an arcuate groove 146' is centrally formed by press on the outward periphery of the metal 10 and extended along the length thereof and then terminated at a position in registry with the ends of the rectangular groove 141', a plurality of the string holes 148' in predetermined number and space are mechanically punched through the grooves 141' and 146' for anchoring strings 15 prior to that the metal 10' is bent to regular shape of racket hereupon. Since that the screw holes 121 on the frame and the transverse portion 16 remain unchange is not intended to give further description.

Figure 4:
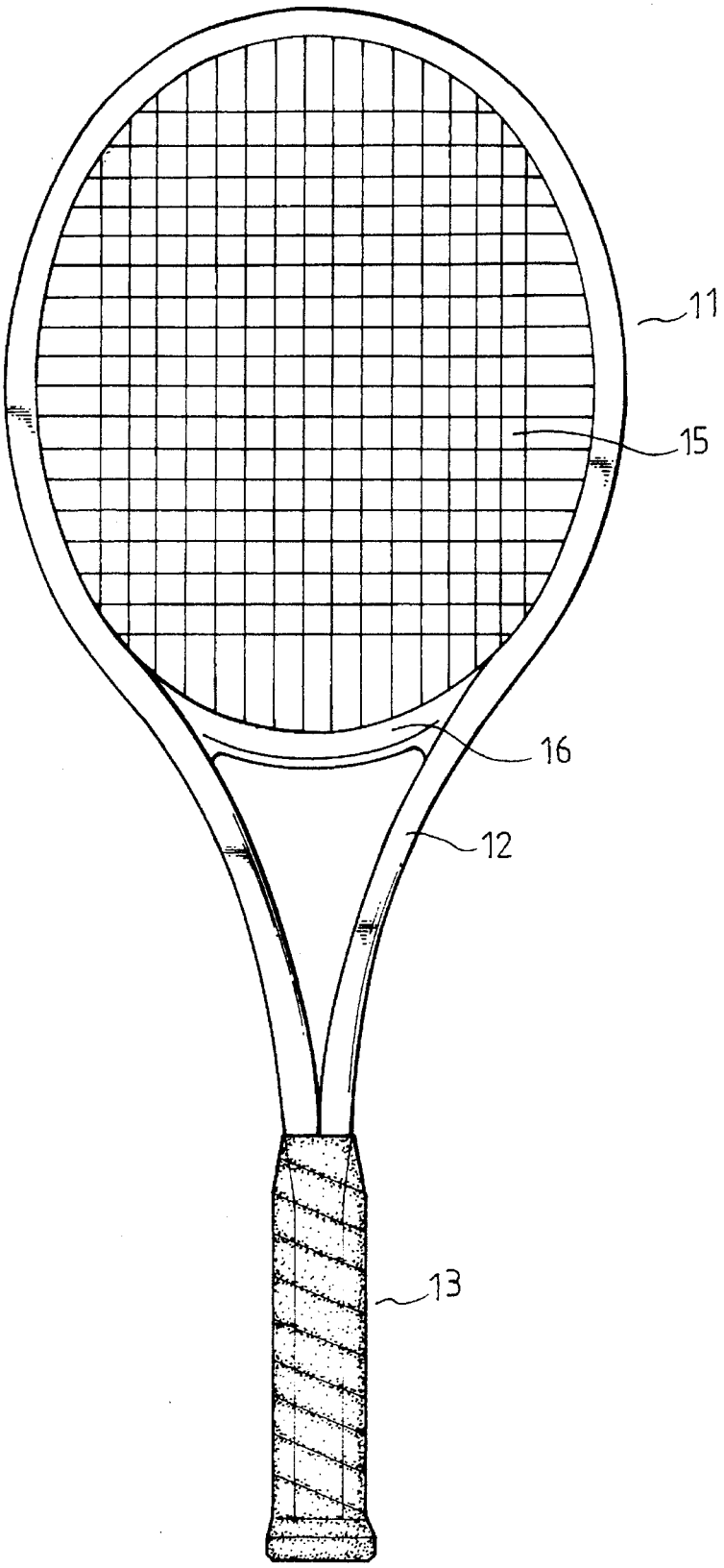
FIG. 4 is an elevational view to show a racket of the preferred embodiment according to the present invention.

Referring to FIG. 4, a racket of the presect invention is completed including an oval shaped frame 11, a throat 12 and a handle 13, a transverse portion 16 which is screw connected to the frame above the throat and a stringing surface 15. The handle 13 is formed by two ends of the tubular metal 10 in juxtaposition and bound by vibration absorbing material.

Based on above recited embodiments, the structure of racket of the present invention provides a simplified durable structure which saves the time and cost to manufacture.

Note that the specification relates to the above embodiments should be construed as to exemplary rather than to limitative of the present invention with many variations and modification being readily attainable by a person of average skill in the art without aparting from the spirit or scope thereof as defined by the appended claims and their legal equivalents.

I claim:

1. A structure of racket comprising an oval shaped head, a throat and a handle formed by a tubular metal:

said tubular metal comprising an olive shaped cross section having a rectangular groove centrally extended on the inward periphery and an arcuate groove centrally extended on the outward periphery along the length thereof and terminated at a position above said throat, said rectangular groove and said arcuate groove being lengthily connected along lateral sides by a pair of symmetrically arcuate ribs inside said tubular metal;

a plurality of string holes in predetermined number and space formed through said grooves and a pair of screw holes formed abutting the ends of said grooves;

a transverse portion having an arcuate upper edge accommodating the curvature on inward periphery of said oval shaped head, said transverse portion comprising a rectangular groove centrally formed on under side and an arcuate groove centrally formed on the upper side a long the length thereof, a plurality of said string holes punched through said grooves in predetermined number and space and a pair of screw holes formed at two ends thereof.

2. A structure of racket according to claim 1, wherein said handle is formed by juxtaposing the ends of said tubular metal and bound with vibration absorbing material.

3. A structure of racket comprising an oval shaped head, a throat and a handle formed by a tubular metal:

said tubular metal comprising an olive shaped cross section having a rectangular groove centrally extended on the inward periphery and an arcuate groove centrally extended on the outward periphery along the length thereof and terminated at a position above said throat;

a plurality of string holes in predetermined number and space punched through said grooves and a pair of screw holes formed abutting the ends of said grooves;

a transverse portion having an arcuate upper edge accommodating the curvature on inward periphery of said oval shaped head, said transverse portion comprising a rectangular groove centrally formed on under side and an arcuate groove centrally formed on the upper side along the length thereof, a plurality of said string holes punched through said grooves in predetermined number and space and a pair of screw holes formed at two ends thereof.

4. A structure of racket according to claim 3, wherein said handle is formed by juxtaposing the ends of said tubular metal and bound with vibration absorbing material.

* * * * *